US009663743B2

(12) United States Patent
Griffin et al.

(10) Patent No.: US 9,663,743 B2
(45) Date of Patent: May 30, 2017

(54) LUBRICATING METHOD AND COMPOSITION FOR REDUCING ENGINE DEPOSITS

(75) Inventors: Paul G. Griffin, Glen Allen, VA (US); Ian A. Bell, Middlesex (GB); John T. Loper, Richmond, VA (US); William Y. Lam, Glen Allen, VA (US); Gregory H. Guinther, Richmond, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 1295 days.

(21) Appl. No.: 12/482,087

(22) Filed: Jun. 10, 2009

(65) Prior Publication Data

US 2010/0317552 A1 Dec. 16, 2010

(51) Int. Cl.
*C10M 141/12* (2006.01)

(52) U.S. Cl.
CPC .... *C10M 141/12* (2013.01); *C10M 2207/028* (2013.01); *C10M 2215/223* (2013.01); *C10M 2215/30* (2013.01); *C10N 2210/06* (2013.01); *C10N 2230/04* (2013.01); *C10N 2230/08* (2013.01); *C10N 2230/52* (2013.01); *C10N 2240/102* (2013.01); *C10N 2240/103* (2013.01); *C10N 2240/104* (2013.01)

(58) Field of Classification Search
USPC ..... 508/279, 382
See application file for complete search history.

(56) References Cited

U.S. PATENT DOCUMENTS

| | | | | |
|---|---|---|---|---|
| 2,384,577 | A | 9/1945 | Thomas | |
| 2,710,872 | A | 6/1955 | Thompson | |
| 2,786,866 | A | 3/1957 | Hook et al. | |
| 2,897,152 | A | 7/1959 | Elliot et al. | |
| 3,219,666 | A | 11/1965 | Norman et al. | |
| 3,356,702 | A | 12/1967 | Farmer et al. | |
| 3,407,222 | A | 10/1968 | Lies | |
| 3,509,051 | A | 4/1970 | Farmer et al. | |
| 3,565,804 | A | 2/1971 | Honnen et al. | |
| 3,697,574 | A | 10/1972 | Piasek et al. | |
| 3,736,357 | A | 5/1973 | Piasek et al. | |
| 3,794,081 | A | 2/1974 | Fiser | |
| 3,867,359 | A | 2/1975 | Beadle | |
| 4,029,587 | A | 6/1977 | Koch | |
| 4,098,705 | A | 7/1978 | Sakurai et al. | |
| 4,164,473 | A | 8/1979 | Coupland et al. | |
| 4,178,258 | A | 12/1979 | Papay et al. | |
| 4,234,435 | A | 11/1980 | Meinhardt et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | de Vries et al. | |
| 4,266,945 | A | 5/1981 | Kam | |
| 4,272,387 | A | 6/1981 | King et al. | |
| 4,283,295 | A | 8/1981 | de Vries et al. | |
| 4,285,822 | A | 8/1981 | de Vries et al. | |
| 4,362,633 | A | 12/1982 | Spence et al. | |
| 4,369,119 | A | 1/1983 | de Vries et al. | |
| 4,395,343 | A | 7/1983 | de Vries et al. | |
| 4,402,840 | A | 9/1983 | de Vries et al. | |
| 4,466,901 | A | 8/1984 | Hunt et al. | |
| 4,636,322 | A | 1/1987 | Nalesnik | |
| 4,692,256 | A | 9/1987 | Umemura et al. | |
| 4,758,362 | A | 7/1988 | Butke | |
| 4,765,918 | A | 8/1988 | Love et al. | |
| 4,767,551 | A | 8/1988 | Hunt et al. | |
| 4,867,890 | A | 9/1989 | Colclough et al. | |
| 4,876,375 | A | 10/1989 | Lam | |
| 4,885,365 | A | 12/1989 | Lam | |
| 4,889,647 | A | 12/1989 | Rowan et al. | |
| 4,904,401 | A | 2/1990 | Ripple et al. | |
| 4,927,552 | A | 5/1990 | Lam | |
| 4,957,643 | A | 9/1990 | Lam | |
| 4,957,649 | A | 9/1990 | Ripple et al. | |
| 4,966,719 | A | 10/1990 | Coyle et al. | |
| 4,978,464 | A | 12/1990 | Coyle et al. | |
| 4,981,603 | A * | 1/1991 | Demange | 508/192 |
| 4,990,271 | A | 2/1991 | Francis | |
| 4,995,996 | A | 2/1991 | Coyle et al. | |
| 5,080,815 | A | 1/1992 | Fenoglio et al. | |
| 5,137,647 | A | 8/1992 | Karol | |
| 5,174,915 | A | 12/1992 | Hutchison et al. | |
| 5,412,130 | A | 5/1995 | Karol | |
| 5,454,962 | A | 10/1995 | Slama et al. | |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,686,397 | A | 11/1997 | Baranski et al. | |
| 5,693,598 | A | 12/1997 | Abraham et al. | |
| 5,789,357 | A | 8/1998 | Baranski et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,902,776 | A | 5/1999 | Dohner et al. | |
| 5,936,041 | A | 8/1999 | Diana et al. | |
| 6,103,674 | A | 8/2000 | Nalesnik et al. | |
| 6,114,288 | A | 9/2000 | Fujitsu et al. | |
| 6,117,826 | A | 9/2000 | Baranski et al. | |
| 6,174,842 | B1 * | 1/2001 | Gatto et al. | 508/364 |
| 6,232,276 | B1 | 5/2001 | Stiefel | |
| 6,509,303 | B1 | 1/2003 | Gatto | |

(Continued)

FOREIGN PATENT DOCUMENTS

| | | |
|---|---|---|
| EP | 330522 B1 | 8/1989 |
| EP | 663436 A1 | 7/1995 |

*Primary Examiner* — Taiwo Oladapo

(74) *Attorney, Agent, or Firm* — Luedeka Neely Group, PC

(57) ABSTRACT

A lubricant composition, lubricant concentrate and method for reducing engine deposits. The composition and method include a base oil of lubricating viscosity; an organo-molybdenum compound; a deposition reducing amount of a reaction product of an alkyl-substituted dicarboxylic acid compound selected from the group consisting of alkyl-substituted dicarboxylic acids, alkyl-substituted dicarboxylic acid anhydrides, and mixtures thereof, and a basic salt of aminoguanidine, in an amount sufficient to provide a product rich in alkyl bis-3-amino-1,2,4-triazole; and optionally a phenate detergent. The lubricant composition and method provide engine deposits that are less than an amount of engine deposits in the absence of component (c) and/or optional component (d).

8 Claims, No Drawings

(56) References Cited

U.S. PATENT DOCUMENTS

| | | | |
|---|---|---|---|
| 6,528,463 | B1 | 3/2003 | Gatto et al. |
| 6,599,865 | B1 | 7/2003 | Esche, Jr. et al. |
| 6,797,677 | B2 | 9/2004 | Esche, Jr. et al. |
| 2004/0266630 | A1 | 12/2004 | George et al. |

* cited by examiner

LUBRICATING METHOD AND COMPOSITION FOR REDUCING ENGINE DEPOSITS

TECHNICAL FIELD

The disclosure relates to lubricant compositions for internal combustion engines and in particular to lubricant compositions containing a lubricant additive that is effective to reduce engine deposits when the lubricant composition contains a molybdenum compounds.

BACKGROUND AND SUMMARY

Lubricating oil compositions for use in crankcases of internal combustion engines are well known. Such compositions may contain one or more additives to improve certain properties, e.g., additives which serve as friction modifiers, anti-oxidants, detergents, dispersants, corrosion inhibitors, wear reducing additives, and other additives.

Among the various types of internal combustion engines are spark ignition engines which are used primarily for automotive and small engine applications. Such spark ignition engines may require lubricants that contain one or more friction modifiers, wear reducing agents, and the like in order to protect engine parts, reduce engine wear, and/or improve fuel economy. Certain friction modifiers and metal-containing compounds or combinations of friction modifiers and metal-containing compounds may be particularly useful for improving some performance characteristics of internal combustion engines while at the same time causing the formation of unwanted engine deposits. The foregoing is particularly true of molybdenum-containing compounds. At relatively low concentration levels, molybdenum compounds may contribute to an increase in engine deposits. At relatively high levels, molybdenum compounds are more effective for improving fuel economy but may contribute substantially more to the formation of higher levels of unwanted engine deposits. Accordingly, what is needed is a lubricant composition that not only improves fuel economy, but also does not contribute higher levels of unwanted engine deposits.

In view of the foregoing, exemplary embodiments of the disclosure provide a lubricant composition, lubricant concentrate and method for reducing engine deposits. The composition and method include a base oil of lubricating viscosity; an organo-molybdenum compound providing about 400 ppm or more molybdenum metal by weight to the lubricant composition based on a total weight of the lubricant composition; a deposition reducing amount of a reaction product of an alkyl-substituted dicarboxylic acid compound selected from the group consisting of alkyl-substituted dicarboxylic acids, alkyl-substituted dicarboxylic acid anhydrides, and mixtures thereof, and a basic salt of aminoguanidine, in an amount sufficient to provide a product rich in alkyl bis-3-amino-1,2,4-triazole; and optionally a phenate detergent. The lubricant composition and method provide engine deposits that are less than an amount of engine deposits in the absence of component (c) and/or optional component (d).

In another embodiment, the disclosure provides a deposit reducing additive concentrate for an engine crankcase lubricant that includes an organo-molybdenum compound; a deposition reducing amount of a reaction product of an alkyl-substituted dicarboxylic acid compound selected from the group consisting of alkyl-substituted dicarboxylic acids, alkyl-substituted dicarboxylic acid anhydrides, and mixtures thereof, and a basic salt of aminoguanidine, in an amount sufficient to provide a product rich in alkyl bis-3-amino-1,2,4-triazole; and optionally a phenate detergent.

The disclosure also provides a method for reducing deposits in an internal combustion engine. According to the method, an engine is lubricated with a lubricant composition that includes lubricating an engine with a composition that includes a base oil of lubricating viscosity; an organo-molybdenum compound; a deposition reducing amount of a reaction product of an alkyl-substituted dicarboxylic acid compound selected from the group consisting of alkyl-substituted dicarboxylic acids, alkyl-substituted dicarboxylic acid anhydrides, and mixtures thereof, and a basic salt of aminoguanidine, in an amount sufficient to provide a product rich in alkyl bis-3-amino-1,2,4-triazole; and optionally a phenate detergent. The lubricant composition provides engine deposits that are less than an amount of engine deposits in the absence of component (c) and/or optional component (d).

A further embodiment of the disclosure provides a lubricant composition for reducing engine deposits. The composition and method include a base oil of lubricating viscosity; an organo-molybdenum compound providing less than about 400 ppm molybdenum metal by weight to the lubricant composition based on a total weight of the lubricant composition; a deposition reducing amount of a reaction product of an alkyl-substituted dicarboxylic acid compound selected from the group consisting of alkyl-substituted dicarboxylic acids, alkyl-substituted dicarboxylic acid anhydrides, and mixtures thereof, and a basic salt of aminoguanidine, in an amount sufficient to provide a product rich in alkyl bis-3-amino-1,2,4-triazole; and optionally a phenate detergent. The lubricant composition and method provide engine deposits that are less than an amount of engine deposits in the absence of component (c) and/or optional component (d).

As described in more detail below, the disclosed embodiments may be effective for reducing engine deposits, particularly deposits associated with turbocharger bearings, while at the same time maintaining improved fuel economy by allowing the use of higher amounts of organo-molybdenum compounds. The results of using the additive component rich in alkyl bis-3-amino-1,2,4-triazole alone, or in combination with a phenate detergent are surprising and quite unexpected. Further features and advantages of the disclosed embodiments may be provided in the following detailed description.

DESCRIPTION AND PREFERRED EMBODIMENTS

According to the disclosed embodiments, there is provided a lubricating oil composition for use in a crankcase of a combustion engine that includes molybdenum metal from an organomolybdenum compound and includes a major proportion of an oil of lubricating viscosity and a minor (deposit reducing) amount of a component that is rich in hydrocarbyl bis-3-amino-1-2,4-triazole. A particularly suitable hydrocarbyl bis-3-amino-1,2,4-triazole is a polyalkylene bis-3-amino-1,2,4-triazole as described in more detail below.

As used herein, the term "hydrocarbyl" refers to a group having a carbon atom attached to the remainder of the molecule and having predominantly hydrocarbon character. Examples of hydrocarbyl groups include:

a) hydrocarbon substituents, that is, aliphatic (e.g., alkyl or alkenyl), alicyclic (e.g., cycloalkyl, cycloalkenyl)

substituents, and aromatic-, aliphatic-, and alicyclic-substituted aromatic substituents, as well as cyclic substituents wherein the ring is completed through another portion of the molecule (e.g., two substituents together form an alicyclic radical);

b) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

c) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The deposit reducing component may be prepared by reacting a hydrocarbyl-substituted dicarboxylic acid compound selected from the group consisting of alkyl-substituted dicarboxylic acids, alkyl-substituted dicarboxylic acid anhydrides, and mixtures thereof, and a basic salt of aminoguanidine, e.g., aminoguanidine bicarbonate (AGB), in specific amounts to form a mixture of products.

A "minor" amount of the deposit reducing component is an amount that may be within the range of about 0.001 wt % to about 10 wt %, based on the total weight of the lubricating oil composition. Suitably, the amount may be within the range of about 0.005 wt % to about 5 wt % and, more desirably, the amount may be within the range of about 0.2 wt % to about 2.0 wt %, based on the total weight of the lubricating oil composition. Another suitable range may be from about 0.5 to about 1.5 weight percent based on a total weight of the lubricant composition.

As used herein, the phrase "rich in a hydrocarbyl bis-3-amino-1,2,4-triazole" means that the hydrocarbyl bis-3-amino-1,2,4-triazole is present in an amount that is sufficient to provide at least some reduction in engine deposit formation.

As set forth above, one of the reactants used to make the deposit reducing component may be an alkyl-substituted dicarboxylic acid compound selected from the group consisting of alkyl-substituted dicarboxylic acids, alkyl-substituted dicarboxylic acid anhydrides, and mixtures thereof. Such substituted dicarboxylic acid compound may be prepared normally by the alkylation of an unsaturated acid, an anhydride of such acid, or a mixture thereof with homopolymers and interpolymers of polymerizable olefin monomers containing up to about 10 carbon atoms. Such polymers may be produced typically from ethylene, propylene, 1-butene, 2-butene, isobutene, 1-hexene, or 1-octene and have at least 30 carbon atoms in a chain. Of the foregoing, a particularly useful polymer may be polybutene.

The alkyl radical of the dicarboxylic acid or anhydride may be any oil-solubilizing organic radical. For example, the alkyl radical may be any hydrocarbon group having from 1 to 200 carbon atoms, saturated or unsaturated. Typically, the chain of carbon atoms in the alkyl radical ranges from about 30 carbon atoms to about 200 carbon atoms, or higher; suitably, from about 50 carbon atoms to about 200 carbon atoms; and, more desirably, from about 60 carbon atoms to about 160 carbon atoms.

The alkyl radical may also be an alkenyl group derived from polypropylene or polyethylene of molecular weight in the range of 200 to 5000. The alkyl radical may be alkyl groups derived from the "dimer acids" or dimerized fatty acids having carbon atoms within the range of 8 to 30 carbon atoms, some acids of which may contain unsaturation, for example, those derived from oleic or linoleic acids. Further, the alkyl radical may be an alkyl group derived from linear or branched alkenes having from 4 to 30 carbon atoms, for example, n-dodecyl, t-dodecyl, t-nonyl, or t-octyl. The number average molecular weight of the hydrocarbyl component of the hydrocarbyl-substituted dicarboxylic acid or anhydride compound may range from about 900 to about 5000 daltons, for example from about 950 to about 3000 daltons, and more desirably from about 950 to about 2500 daltons. In one embodiment, the alkyl radical may be an alkenyl group derived from polyisobutylene of number average molecular weight in the range of 250 to 5000.

The acids that are contemplated for use in making the desired dicarboxylic acid compounds are unsaturated. Such acids, and derivatives thereof, as acrylic acid, methacrylic acid, maleic acid, maleic anhydride, citraconic acid, and citraconic anhydride are contemplated. Other possible dicarboxylic acid sources are malonic acid, glutaric acid, adipic acid, and alkylated aromatic dicarboxylic acids, e.g, phthalic acid. The acid that is employed, when used in the specified amount relative to that of AGB, must provide a final product that is rich in alkyl bis-3-amino-1,2,4-triazole. A particularly desirable acid and its anhydride are succinic acid and succinic anhydride. When polyisobutyl succinic anhydride is reacted with AGB, the principal product is polybutenyl bis-3-amino-1-2,4-triazole.

For convenience only, the following discussion will be directed to the use of polybutenyl succinic anhydride (PSA) as the alkyl-substituted dicarboxylic acid compound. The reaction between PSA and AGB may be conducted at more than one relative ratio of reactants. In one instance, one mole of PSA may be reacted with one mole of AGB. The resulting product may produce an infrared spectrum having a dominant peak at 1735 $cm^{-1}$ with a shoulder at 1700 $cm^{-1}$. On the other hand, when one mole of PSA is reacted with two moles of AGB, the product may have an infrared spectrum having a dominant peak at 1640 $cm^{-1}$, smaller peaks at approximately 1700 $cm^{-1}$, and characteristic "N—H" stretching bands at 3200-3500 $cm^{-1}$. Compounds having the foregoing spectra are known to be triazole compounds. The stoichiometry suggests that the product may be primarily a bistriazole having the following structure:

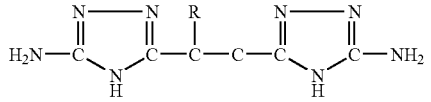

wherein R is a polybutyenyl group. The foregoing structure is that of polybutenyl bis-3-amino-1,2,4-triazole. Such a product contains a relatively high nitrogen content, within the range of about 1.8 wt % to about 2.9 wt % nitrogen.

The five-membered ring of the triazoles is considered to be aromatic. Depending upon the salt formed, the aminotriazole will exhibit both acidic and basic properties. The aminotriazoles are fairly stable to oxidizing agents and are extremely resistant to hydrolysis.

The foregoing product may be obtained by reacting PSA and AGB in appropriate amounts at a temperature within the range of about 155° C. to about 200° C., for example, within the range of about 170° C. to about 190° C., and at atmospheric pressure. Of course, the reaction may be carried out at subatmospheric pressure or superatmospheric pressure. In either case, the range of temperatures may be different from those listed for the reaction that is carried out at atmospheric pressure. The ratio of reactants may be within the range of about 1.6 moles of AGB per mole of PSA to about 2 moles of AGB per mole of PSA, suitably, within the range of about 1.7 moles of AGB per mole of PSA to about 2 moles of AGB per mole of PSA. The reaction may be carried out for a period of time within the range of about 1 hour to about 4 hours, for example, within the range of about 2 hours to about 4 hours.

As shown in the examples presented hereinafter, deposit reducing component has been found to significantly decrease engine deposits for lubricant composition containing a molybdenum compound as an additive as determined by a TEOST method 33 analysis of the lubricant composition.

Friction Modifier Component

As set forth above, a lubricant composition containing an organo-molybdenum compound may be used to provide improved fuel economy. The organo-molybdenum compound may be selected from sulfur and/or phosphorus-containing organomolybdenum compounds or sulfur and phosphorus-free organomolybdenum compounds.

A sulfur- and phosphorus-free organomolybdenum compound that may be used as a friction modifier may be prepared by reacting a sulfur- and phosphorus-free molybdenum source with an organic compound containing amino and/or alcohol groups. Examples of sulfur- and phosphorus-free molybdenum sources include molybdenum trioxide, ammonium molybdate, sodium molybdate and potassium molybdate. The amino groups may be monoamines, diamines, or polyamines. The alcohol groups may be mono-substituted alcohols, diols or bis-alcohols, or polyalcohols. As an example, the reaction of diamines with fatty oils produces a product containing both amino and alcohol groups that can react with the sulfur- and phosphorus-free molybdenum source.

Examples of sulfur- and phosphorus-free organomolybdenum compounds include compounds described in the following patents: U.S. Pat. Nos. 4,259,195; 4,261,843; 4,164,473; 4,266,945; 4,889,647; 5,137,647; 4,692,256; 5,412,130; 6,509,303; and 6,528,463.

Molybdenum compounds prepared by reacting a fatty oil, diethanolamine, and a molybdenum source as described in U.S. Pat. No. 4,889,647 are sometimes illustrated with the following structure, where R is a fatty alkyl chain, although the exact chemical composition of these materials is not fully known and may in fact be multi-component mixtures of several organomolybdenum compounds.

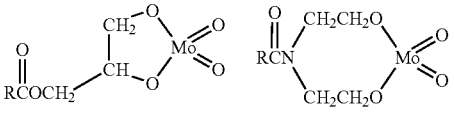

Sulfur-containing organomolybdenum compounds may be used and may be prepared by a variety of methods. One method involves reacting a sulfur and phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing molybdenum compound may be prepared by reacting a sulfur-containing molybdenum source with an amino group or thiuram group and optionally a second sulfur source Examples of sulfur-containing organomolybdenum compounds include compounds described in the following patents: U.S. Pat. Nos. 3,509,051; 3,356,702; 4,098,705; 4,178,258; 4,263,152; 4,265,773; 4,272,387; 4,285,822; 4,369,119; 4,395,343; 4,283,295; 4,362,633; 4,402,840; 4,466,901; 4,765,918; 4,966,719; 4,978,464; 4,990,271; 4,995,996; 6,232,276; 6,103,674; and 6,117,826.

The amount of organomolybdenum compound in the lubricant composition may be substantially higher in the presence of the deposit reducing component that is rich in hydrocarbyl bis-3-amino-1-2,4-triazole than an amount of organomolybdenum compound in the absence of the deposit reducing component. Accordingly, the lubricant composition may contain an amount of organomolybdenum compound that is effective to provide at least about 400 ppm molybdenum metal to the lubricant composition based on the total weight of the lubricant composition. Typical ranges of the molybdenum metal in the lubricant composition provided by the organomolybdenum compound may range from about 20 to about 1000 ppm or molybdenum metal or more based on the total weight of the lubricant composition.

Glycerides may also be used alone or in combination with other friction modifiers. Suitable glycerides include glycerides of the formula:

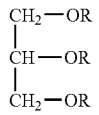

wherein each R is independently selected from the group consisting of H and C(O)R' where R' may be a saturated or an unsaturated alkyl group having from 3 to 23 carbon atoms. Examples of glycerides that may be used include glycerol monolaurate, glycerol monomyristate, glycerol monopalmitate, glycerol monostearate, and mono-glycerides derived from coconut acid, tallow acid, oleic acid, linoleic acid, and linolenic acids. Typical commercial monoglycerides contain substantial amounts of the corresponding diglycerides and triglycerides. Any ratio of mono- to diglyceride may be used, however, it is preferred that from 30 to 70% of the available sites contain free hydroxyl groups (i.e., 30 to 70% of the total R groups of the glycerides represented by the above formula are hydrogen). A preferred glyceride is glycerol monooleate, which is generally a mixture of mono, di, and tri-glycerides derived from oleic acid, and glycerol.

Other components may be used in the lubricant compositions according to the disclosure to provide an additive package for engine oil lubrication applications. Such components may include, but are not limited to detergents, dispersants, antioxidants, viscosity index improvers, anti-wear agents, foam control agents, corrosion inhibitors, and the like.

Metallic Detergents

Certain metallic detergents may optionally be included in the additive package and lubricant compositions described herein. A suitable metallic detergent may include an oil-soluble neutral or overbased salt of alkali or alkaline earth metal with one or more of the following acidic substances (or mixtures thereof): (1) a sulfonic acid, (2) a carboxylic acid, (3) a salicylic acid, (4) an alkyl phenol, (5) a sulfurized alkyl phenol, and (6) an organic phosphorus acid characterized by at least one direct carbon-to-phosphorus linkage. Such an organic phosphorus acid may include those prepared by the treatment of an olefin polymer (e.g., polyisobutylene having a molecular weight of about 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

Suitable salts may include neutral or overbased salts of magnesium, calcium, or zinc. As a further example, suitable salts may include magnesium sulfonate, calcium sulfonate, zinc sulfonate, magnesium phenate, calcium phenate, and/or zinc phenate. See, e.g., U.S. Pat. No. 6,482,778.

Examples of suitable metal-containing detergents include, but are not limited to, neutral and overbased salts such as a sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a magnesium sulfonate, a magnesium carboxylate, a magnesium salicylate, a magnesium phenate, a sulfurized magnesium phenate, a calcium sulfonate, a calcium carboxylate, a calcium salicylate, a calcium phenate, a sulfurized calcium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate. Further examples include a lithium, sodium, potassium, calcium, and magnesium salt of a hydrolyzed phosphosulfurized olefin having about 10 to about 2,000 carbon atoms or of a hydrolyzed phosphosulfurized alcohol and/or an aliphatic-substituted phenolic compound having about 10 to about 2,000 carbon atoms. Even further examples include a lithium, sodium, potassium, calcium, and magnesium salt of an aliphatic carboxylic acid and an aliphatic substituted cycloaliphatic carboxylic acid and many other similar alkali and alkaline earth metal salts of oil-soluble organic acids. A mixture of a neutral or an overbased salt of two or more different alkali and/or alkaline earth metals can be used. Likewise, a neutral and/or an overbased salt of mixtures of two or more different acids can also be used.

While any effective amount of the metallic detergents may be used to enhance the benefits of this invention, typically these effective amounts will range from about 0.01 to about 2.0 wt. % in the finished fluid, or as a further example, from about 0.1 to about 1.5 wt. % in the finished fluid. A particularly useful detergent may include a calcium phenate detergent having a total base number (TBN) ranging from about 20 to about 400, typically from about 50 to about 250 TBN, desirably from about 60 to about 160 TBN. In one embodiment, the amount of phenate detergent in a lubricant composition according to the disclosure may range from about 0.2 to about 1.5 weight percent based on the total weight of the lubricant composition.

Dispersant Components

Dispersants that may be used in an additive package include, but are not limited to, ashless dispersants that have an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succcinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

Antiwear Agents

The antiwear agents may include phosphorus-containing antiwear agents which may include an organic ester of phosphoric acid, phosphorous acid, or an amine salt thereof. For example, the phosphorus-containing antiwear agent may include one or more of a dihydrocarbyl phosphite, a trihydrocarbyl phosphite, a dihydrocarbyl phosphate, a trihydrocarbyl phosphate, any sulfur analogs thereof, and any amine salts thereof. As a further example, the phosphorus-containing antiwear agent may include at least one of dibutyl hydrogen phosphite and an amine salt of sulfurized dibutyl hydrogen phosphite.

The phosphorus-containing antiwear agent may be present in an amount sufficient to provide about 50 to about 1000 parts per million by weight of phosphorus in the fully formulated lubricant. As a further example, the phosphorus-containing antiwear agent may be present in an amount sufficient to provide about 150 to about 300 parts per million by weight of phosphorus in the fully formulated lubricant.

The lubricating fluid may include from about 0.01 wt % to about 1.0 wt % of the phosphorus-containing antiwear agent. As a further example, the lubricating fluid may include from about 0.2 wt % to about 1.0 wt % of the phosphorus-containing antiwear agent. As an example, the lubricating fluid may include from about 0.1 wt % to about 0.5 wt % of a dibutyl hydrogen phosphite or 0.3 wt % to about 0.5 wt % an amine salt of a sulfurized dibutyl hydrogen phosphate.

Zinc dialkyl dithiophosphates ("Zn DDPs") may also be used as antiwear agents in lubricating oils. Zn DDPs have good antiwear and antioxidant properties and have been used to pass cam wear tests, such as the Seq. IVA and TU3 Wear Test. Many patents address the manufacture and use of Zn DDPs including U.S. Pat. Nos. 4,904,401; 4,957,649; and 6,114,288. Non-limiting general Zn DDP types are primary, secondary and mixtures of primary and secondary Zn DDPs.

Oxidation Inhibitor Components

Oxidation inhibitor may also be used in a lubricant additive package. Oxidation inhibitors or antioxidants reduce the tendency of base stocks to deteriorate in service which deterioration can be evidenced by the products of oxidation such as sludge and varnish-like deposits that deposit on metal surfaces and by viscosity growth of the finished lubricant. Such oxidation inhibitors include hindered phenols, sulfurized hindered phenols, alkaline earth metal salts of alkylphenolthioesters having $C_5$ to $C_{12}$ alkyl side chains, sulfurized alkylphenols, metal salts of either sulfurized or nonsulfurized alkylphenols, for example calcium nonylphenol sulfide, ashless oil soluble phenates and sulfurized phenates, phosphosulfurized or sulfurized hydrocarbons, phosphorus esters, metal thiocarbamates, and oil soluble copper compounds as described in U.S. Pat. No. 4,867,890. Other antioxidants that may be used include diarylamines, alkylated phenothiazines, sulfurized compounds, and ashless dialkyldithiocarbamates. Sterically hindered phenols and mixtures thereof as described in U.S Publication No. 2004/0266630.

Diarylamine antioxidants include, but are not limited to diarylamines having the formula:

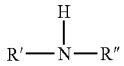

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

Another class of aminic antioxidants includes phenothiazine or alkylated phenothiazine having the chemical formula:

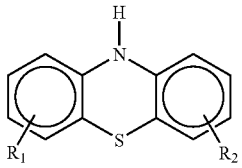

wherein $R_1$ is a linear or branched $C_1$ to $C_{24}$ alkyl, aryl, heteroalkyl or alkylaryl group and $R_2$ is hydrogen or a linear or branched $C_1$-$C_{24}$ alkyl, heteroalkyl, or alkylaryl group.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these. The foregoing aminic, phenothiazine, and sulfur containing antioxidants are described for example in U.S. Pat. No. 6,599,865.

The ashless dialkyldithiocarbamates which may be used as antioxidant additives include compounds that are soluble or dispersable in the additive package. It is also preferred that the ashless dialkyldithiocarbamate be of low volatility, preferably having a molecular weight greater than 250 daltons, most preferably having a molecular weight greater than 400 daltons. Examples of dialkyldithiocarbamates that may be used are disclosed in the following patents U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Organomolybdenum containing compounds used as friction modifiers may also exhibit antioxidant functionality. U.S. Pat. No. 6,797,677 describes a combination of organomolybdenum compound, alkylphenothiazine and alkyldiphenylamines for use in finished lubricant formulations. Examples of suitable molybdenum containing friction modifiers are described below under friction modifiers.

Other Additives

Rust inhibitors selected from the group consisting of nonionic polyoxyalkylene polyols and esters thereof, polyoxyalkylene phenols, and anionic alkyl sulfonic acids may be used.

A small amount of a demulsifying component may be used. A preferred demulsifying component is described in EP 330,522. Such demulsifying component may be obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Seal swell agents, as described, for example, in U.S. Pat. Nos. 3,794,081 and 4,029,587, may also be used.

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Functionalized olefin copolymers that may be used include interpolymers of ethylene and propylene which are grafted with an active monomer such as maleic anhydride and then derivatized with an alcohol or amine. Other such copolymers are copolymers of ethylene and propylene which are grafted with nitrogen compounds.

Base Oil

Base oils suitable for use with present embodiments may comprise one or more oils of lubricating viscosity such as mineral (or natural) oils, synthetic lubricating oils, vegetable oils, and mixtures thereof. Such base oils include those conventionally employed as crankcase lubricating oils for spark-ignited and compression-ignited internal combustion engines, such as automobile and truck engines, marine and railroad diesel engines, and the like. Suitable base oils may have a NOACK volatility of from about 5 to about 15. As another example, suitable base oils may have a NOACK volatility of from about 10 to about 15. As even further example, suitable base oils may have a NOACK volatility of from about 9 to about 13. Base oils are typically classified as Group I, Group II, Group III, Group IV and Group V, as described in Table 1 below.

TABLE 1

| Group I-V Base Oils | | | | |
|---|---|---|---|---|
| Base Oil | % Sulfur | | % Saturates | Viscosity Index |
| Group I | >0.03 | and/or | <90 | 80-120 |
| Group II | ≤0.03 | and/or | ≥90 | 80-120 |
| Group III | ≤0.03 | and/or | ≥90 | ≥120 |
| Group IV | * | | | |
| Group V | ** | | | |

* Group IV base oils are defined as all polyalphaolefins

** Group V base oils are defined as all other base oils not included in Groups I, II, III and IV and may include gas to liquid base oils.

Lubricating base oils may also include oils made from a waxy feed. The waxy feed may comprise at least 40 weight percent n-paraffins, for example greater than 50 weight percent n-paraffins, and more desirably greater than 75 weight percent n-paraffins. The waxy feed may be a conventional petroleum derived feed, such as, for example, slack wax, or it may be derived from a synthetic feed, such as, for example, a feed prepared from a Fischer-Tropsch synthesis.

Non-limiting examples of synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Mineral base oils include, but are not limited to, animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Representative effective amounts of the deposit reducing component and other additives for providing a lubricant composition according to the disclosure are listed in Table 1 below. All the values listed are stated as weight percent active ingredient.

TABLE 2

| Component | Wt. % (Broad) | Wt. % (Typical) |
|---|---|---|
| Dispersant | 0.5-10.0 | 1.0-5.0 |
| Oxidation Inhibitors | 0-10.0 | 0.1-6.0 |
| Metal Detergents | 0.1-15.0 | 0.2-8.0 |
| Corrosion Inhibitor | 0-5.0 | 0-2.0 |
| Antifoaming agent | 0-5.0 | 0.001-0.15 |
| Pour point depressant | 0.01-5.0 | 0.01-1.5 |
| Viscosity modifier | 0.01-20.00 | 0.25-10.0 |
| Molybdenum from organo-molybdenum compound (ppm) | 20-1500 | 50-1000 |
| Alkyl-bis-aminotriazole deposit reducing agent | 0.001-5.0 | 0.01-2.0 |
| Base oil | Balance | Balance |
| Total | 100 | 100 |

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 20% by weight based on the weight of the lubricating oil composition.

The additives may be added directly to the lubricating oil composition. In one embodiment, however, an additive package is diluted with a substantially inert, normally liquid organic diluent such as mineral oil, synthetic oil, naphtha, alkylated (e.g. $C_{10}$ to $C_{13}$ alkyl) benzene, toluene or xylene to form an additive concentrate. The concentrates usually contain from about 1% to about 100% by weight and in one embodiment about 10% to about 90% by weight of the additive mixture.

The use of the alkyl-bis-aminotriazole component and optional phenate component according to the above exemplified compositions provide lubricant compositions that exhibit a decrease in engine deposits compared to the same lubricant compositions in the absence of the alkyl-bis-aminotriazole component and optional phenate component as determined by a TEOST method 33C (TEOST-33C) deposit test. The TEOST-33C test is a bench test that may be used to evaluate engine turbocharger protection. Oxidative degradation and/or thermal coking of engine oil in the turbocharger bearing area during hot shut-down may result in deposit build-up in the bearing area that can lead to loss of engine performance and possible engine failure. Lubricant additive components that go to metal surfaces to keep the engine's parts clean and prevent deposit build-up in the turbocharger, may compete with friction modifier components that go to metal surfaces to reduce friction and improve fuel economy.

About 100 mL of test oil is used in a 12 cycle/2 hour test. The test results in bulk oxidation of the oil (about 100 g) on a hollow heated rod (TEOST depositor rod) that will accumulate the deposits over the test period. The test oil flows over the rod at about 0.5 grams per minute while the test piece is cycled 12 times over a temperature ranging from 200-480° C. The increase in the weight of the rod is the performance parameter measured according to this procedure. The greater the weight gain, the poorer the performance of the additive composition.

The following examples are being presented to aid in the understanding of the present invention. They are being presented for the purpose of illustration only and are not intended to limit the scope of the present invention.

EXAMPLE 1

In the following examples, lubricant formulations containing a molybdenum compound with and without the hydrocarbyl bis-3-amino-1,2,4-triazole (PIB-BAT) component and/or phenate component were evaluated according to the TEOST-33C test. The results are given in the following tables.

TABLE 3

| High Molybdenum Formulation | | | | |
|---|---|---|---|---|
| | Molybdenum (ppm) | PIB-BAT (wt. %) | Phenate (wt. %) | Percent Reduction in deposits |
| Base Formulation | 700 | — | — | 0 |
| Run 1 | 700 | 0.80 | — | 12.9 |
| Run 2 | 700 | 0.80 | 1.0 | 46.7 |
| Run 3 | 611 | — | 1.0 | 21.0 |
| Run 4 | 700 | 0.40 | 1.0 | 18.8 |

TABLE 4

| Low Molybdenum Formulation | | | | |
|---|---|---|---|---|
| | Molybdenum (ppm) | PIB-BAT (wt. %) | Phenate (wt. %) | Percent Reduction in deposits |
| Base Formulation | 60 | — | — | 0 |
| Run 5 | 60 | 0.80 | — | 63.3 |
| Run 6 | 65 | 0.80 | — | 64.2 |

The foregoing results indicated that the deposits as determined by the TEOST-33C test may be lowered significantly with the addition of the PIB-BAT alone in lubricant compositions containing molybdenum compounds. Further reduction may be achieved by the combination of PIB-BAT and the phenate detergent.

At numerous places throughout this specification, reference has been made to a number of U.S. patents and publications. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A lubricant composition for reducing engine deposits, comprising:

a) a base oil of lubricating viscosity;

b) a molybdenum dithiocarbamate compound providing about 350 ppm to about 1000 ppm molybdenum metal by weight to the lubricant composition based on a total weight of the lubricant composition;

c) from about 0.8 to about 2.0 wt. % based on a total weight of a lubricant composition of a reaction product of an alkyl-substituted dicarboxylic acid compound selected from the group consisting of alkyl-substituted dicarboxylic acids, alkyl-substituted dicarboxylic acid anhydrides, and mixtures thereof, and a basic salt of aminoguanidine, that provides an amount of alkyl bis-3-amino-1,2,4-triazole in the reaction product that is sufficient to reduce engine deposits according to a TEOST 33C test in the presence of (d) from about 0.2 to about 1.5 weight percent calcium phenate detergent based on a total weight of the lubricant composition, wherein the calcium phenate detergent has a total base number (TBN) ranging from about 60 to about 160 TBN;

wherein the lubricant composition provides engine deposits according to the TEOST 33C test that are less than an amount of engine deposits in the absence of component (c) and component (d).

2. The lubricant composition of claim 1, wherein the base oil comprises a mineral oil, a synthetic oil, or a mixture thereof.

3. The lubricant composition of claim 1, wherein the base oil comprises on or more of a member selected from the group consisting of: a group I base oil, a group II base oil, a group III base oil, a group IV base oil, and a group V base oil.

4. The lubricant composition of claim 1, wherein the alkyl group of the alkyl bis-3-amino-1,2,4-triazole comprises a polyisobutenyl group having a number average molecular weight ranging from about 950 to about 2500.

5. A deposit reducing additive concentrate for an engine crankcase lubricant comprising:

a) a molybdenum dithiocarbamate compound present in the additive concentrate in an amount that is sufficient to provide from about 350 to about 1000 ppm by weight molybdenum metal to a fully formulated lubricant composition;

b) from about 0.8 to about 2.0 wt. % based on a total weight of a lubricant composition containing the additive concentrate of a reaction product of an alkyl-substituted dicarboxylic acid compound selected from the group consisting of alkyl-substituted dicarboxylic acids, alkyl-substituted dicarboxylic acid anhydrides, and mixtures thereof, and a basic salt of aminoguanidine, that provides an amount of alkyl bis-3-amino-1,2,4-triazole in the reaction product that is sufficient to reduce engine deposits according to a TEOST 33C test in the presence of from about 0.2 to about 1.5 weight percent calcium phenate detergent based on a total weight of the lubricant composition compared to a lubricant composition containing an additive concentrate devoid of the reaction product and the calcium phenate detergent, wherein the calcium phenate detergent has a total base number (TBN) ranging from about 60 to about 160 TBN.

6. A method for reducing deposits in an internal combustion engine, comprising lubricating the engine with a lubricant composition comprising:

(a) a base oil of lubricating viscosity;

b) a molybdenum dithiocarbamate compound providing about 350 ppm to about 1000 ppm molybdenum metal by weight to the lubricant composition based on a total weight of the lubricant composition;

c) from about 0.8 to about 2.0 wt.% based on a total weight of a lubricant composition of a reaction product of an alkyl-substituted dicarboxylic acid compound selected from the group consisting of alkyl-substituted dicarboxylic acids, alkyl-substituted dicarboxylic acid anhydrides, and mixtures thereof, and a basic salt of aminoguanidine, that provides an amount of alkyl bis-3-amino-1,2,4-triazole in the reaction product that is sufficient to reduce engine deposits according to a TEOST 33C test in the presence of (d) from about 0.2 to about 1.5 weight percent calcium phenate detergent based on a total weight of the lubricant composition, wherein the calcium phenate detergent has a total base number (TBN) ranging from about 60 to about 160 TBN;

wherein the lubricant composition provides engine deposits according to the TEOST 33C test that are less than an amount of engine deposits in the absence of component (c) and component (d).

7. The method of claim 6, wherein the base oil comprises a mineral oil, a synthetic oil, or a mixture thereof.

8. The method of claim 6, wherein the base oil comprises on or more of a member selected from the group consisting of: a group I base oil, a group II base oil, a group III base oil, a group IV base oil, and a group V base oil.

* * * * *